US005966814A

United States Patent [19]

Lin

[11] Patent Number: 5,966,814

[45] Date of Patent: Oct. 19, 1999

[54] TUNE-PRODUCING FEEDING UTENSIL

[76] Inventor: Michael Lin, 10st Floor, No. 251, Sung-Choung Street, Taichung, Taiwan

[21] Appl. No.: 09/004,879

[22] Filed: Jan. 9, 1998

[51] Int. Cl.[6] ..... A47J 43/28

[52] U.S. Cl. ..... 30/123; 30/142; 30/324

[58] Field of Search ..... 30/123, 324, 142

[56] References Cited

U.S. PATENT DOCUMENTS

| | | | |
|---|---|---|---|
| 3,510,643 | 5/1970 | File | 30/123 |
| 3,839,793 | 10/1974 | Crapio | 30/123 |
| 4,207,673 | 6/1980 | DiGirolamo et al. | 30/123 |
| 5,075,970 | 12/1991 | Albert | 30/123 |
| 5,189,793 | 3/1993 | Ratzon et al. | 30/123 |
| 5,467,256 | 11/1995 | Chen | 30/123 |

*Primary Examiner*—M. Rachuba
*Assistant Examiner*—Sean Pryor
*Attorney, Agent, or Firm*—W. Wayne Liauh

[57] ABSTRACT

Disclosed is a tune-producing feeding utensil, such as a spoon or a fork. In the case of a spoon, the spoon mainly includes a metal bowl portion, a plastic handle portion, and a metal back cover. The handle portion is provided with compartments for receiving a circuit board and two serially connected button cells, as well as a shallow groove around the compartments for receiving a gasket. When the back cover is fitted onto the handle portion, the circuit board and button cells are sealed in the handle portion and the gasket is tightly pressed against the shallow groove to make the handle portion watertight. When a baby uses the spoon to feed itself with one hand holding the handle portion at the back cover and its mouth contacting with the bowl portion, an integrated circuit on the circuit board is actuated to cause a tune-producing device attached to the back cover to send out music or voice. The music or voice is helpful in encouraging the baby to enjoy feeding itself concentratively.

7 Claims, 4 Drawing Sheets

TUNE-PRODUCING FEEDING UTENSIL

BACKGROUND OF THE INVENTION

The present invention relates to a tune-producing feeding utensil, such as a spoon or a fork. When a baby's mouth contacts with the bowl or prongs of the spoon or fork of the present invention, music or voice will be sent out from the spoon or fork to attract and encourage the baby to enjoy feeding itself concentratively.

Nowadays, most families have only one or two children and they are always the most cherished thing of the parents. Sometimes, the children are unduly pampered. For instance, most small babies like to play around while taking a meal. Some parents would rather to laboriously bring the bowl and spoon or fork in an attempt to follow and feed the baby. It will, therefore, take a considerably long time to finish the meal. The parents are exhausted and the food is no longer warm and delicious. Even when the baby is old enough to feed itself slowly, some parents may still decide to feed the baby. This might very possibly result in a delayed age of the babies for them to feed themselves and forms confusion to the parents. It is therefore desirable to find a way to eliminate the confusion of the parents in feeding their babies.

SUMMARY OF THE INVENTION

It is a primary object of the present invention to provide a tune-producing feeding utensil, such as a spoon or a fork, which can produce pleasant music or voice and therefore encourage babies to enjoy feeding themselves concentratively.

The tune-producing feeding utensil according to the present invention mainly includes a metal main portion (a bowl in the case of a spoon or prongs in the case of a fork), a plastic handle portion, and a metal back cover. The handle portion is provided with compartments for receiving a circuit board and two serially connected button cells, as well as a shallow groove around the compartments for receiving a gasket. When the back cover is fitted onto the handle portion, the circuit board and button cells are sealed in the handle portion and the gasket is tightly pressed against the shallow groove to make the handle portion watertight. When a baby uses the spoon (fork) to feed itself with one hand holding the handle portion at the back cover and its mouth contacting with the bowl (prong) portion, an integrated circuit on the circuit board is actuated to cause a tune-producing device attached to the back cover to send out music or voice. The music or voice is helpful in encouraging the baby to enjoy feeding itself.

BRIEF DESCRIPTION OF THE DRAWINGS

The structure and the features of the present invention can be best understood by referring to the following detailed description of the preferred embodiments and the accompanying drawings, wherein.

DETAILED DESCRIPTION OF THE PREFERRED EMBODIMENTS

The present invention relates to a tune-producing feeding utensil, such as a spoon or a fork. A tune-producing spoon according to a preferred embodiment of the present invention will be now be shown and described in details to illustrate the application of the principles of the present invention. However, it is understood that the invention may be embodied otherwise without departing from such principles.

Figure 1:
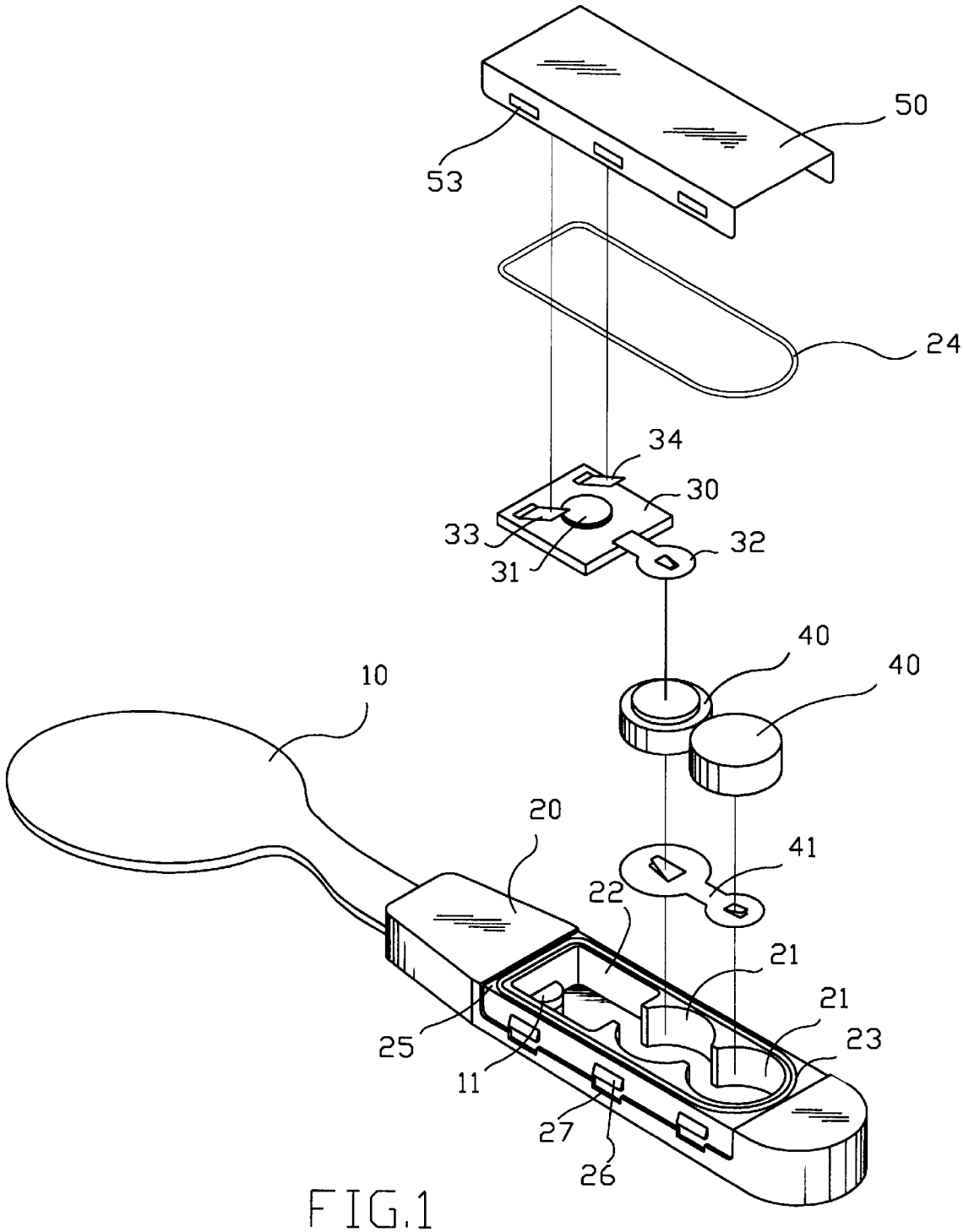
FIG. 1 is an exploded perspective of a tune-producing spoon according to a preferred embodiment of the present invention.
Figure 2:
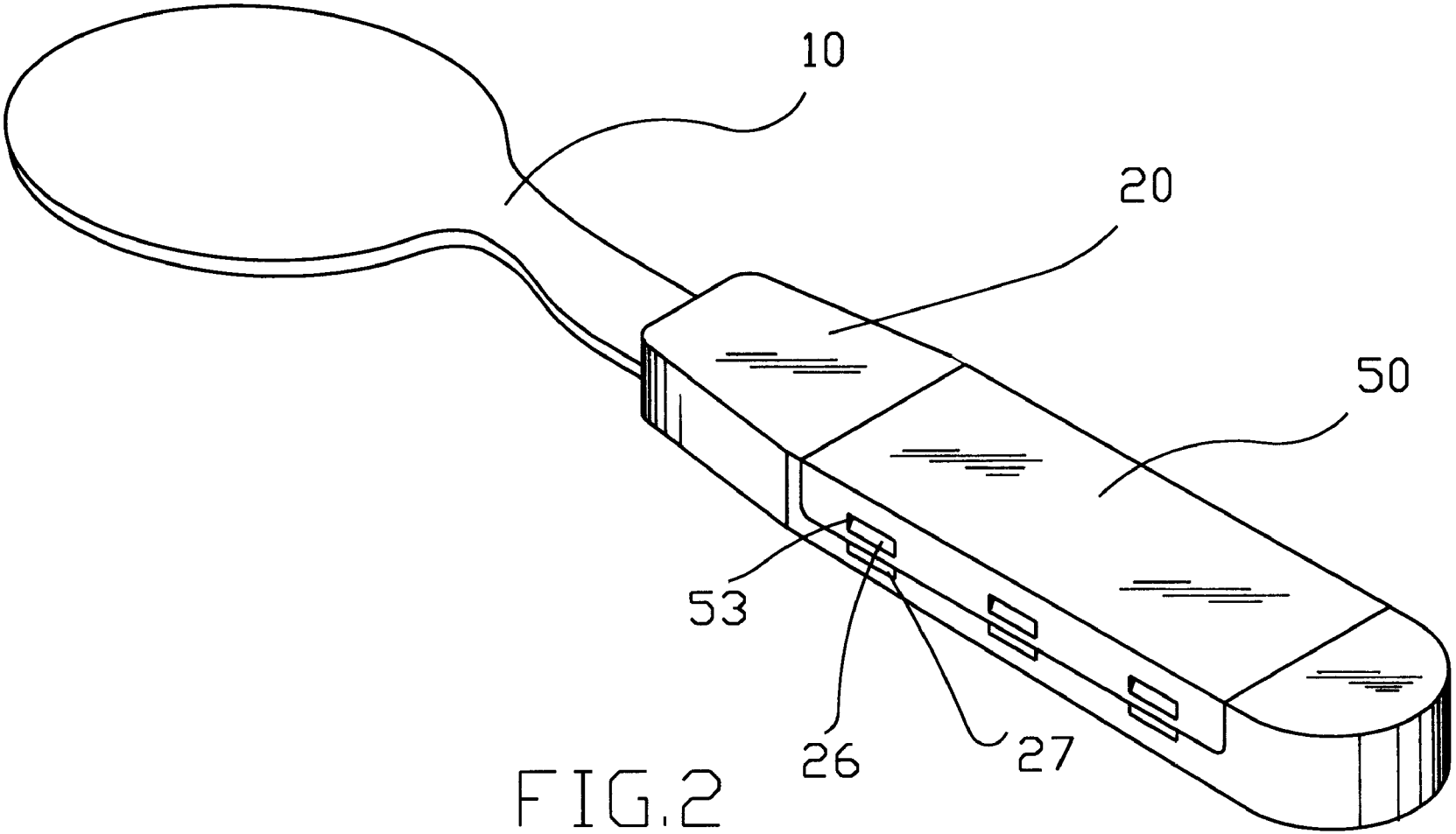
FIG. 2 is an assembled perspective of the tune-producing spoon of FIG. 1.

Please refer to FIG. 1. The tune-producing spoon of the present invention mainly includes a metal bowl portion 10, a plastic handle portion 20, a circuit board 30, two button cells 40, and a metal back cover 50.

The plastic handle portion 20 is provided with compartments 21 for receiving the button cells 40 and compartment 22 for receiving the circuit board 30. A continuous shallow groove 23 is formed around the compartments 21, 22 for receiving a gasket 24 therein.

The metal bowl portion 10 is fixedly connected to the plastic handle portion 20 with an inner end 11 extending into the circuit board compartment 22 of the handle portion 20.

The two button cells 40 are positioned in the compartment 21 of the handle portion 20 and are serially connected to one another by means of a conductive elastic plate 41.

Figure 3:
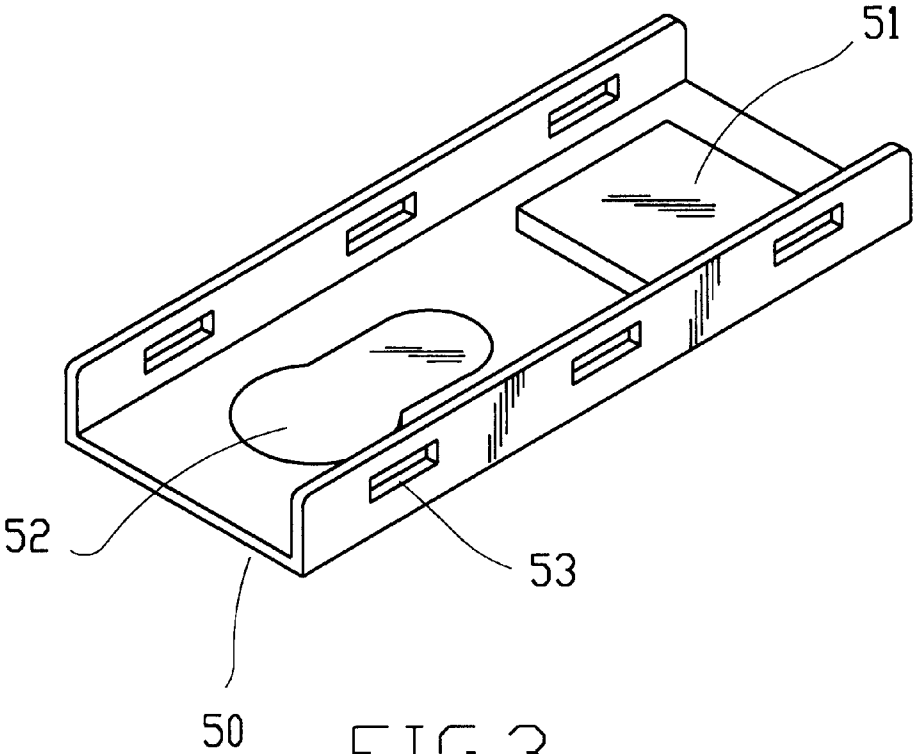
FIG. 3 is a perspective of the back cover of the tune-producing spoon of FIG. 1, showing an inner side of a back cover thereof.
Figure 5:
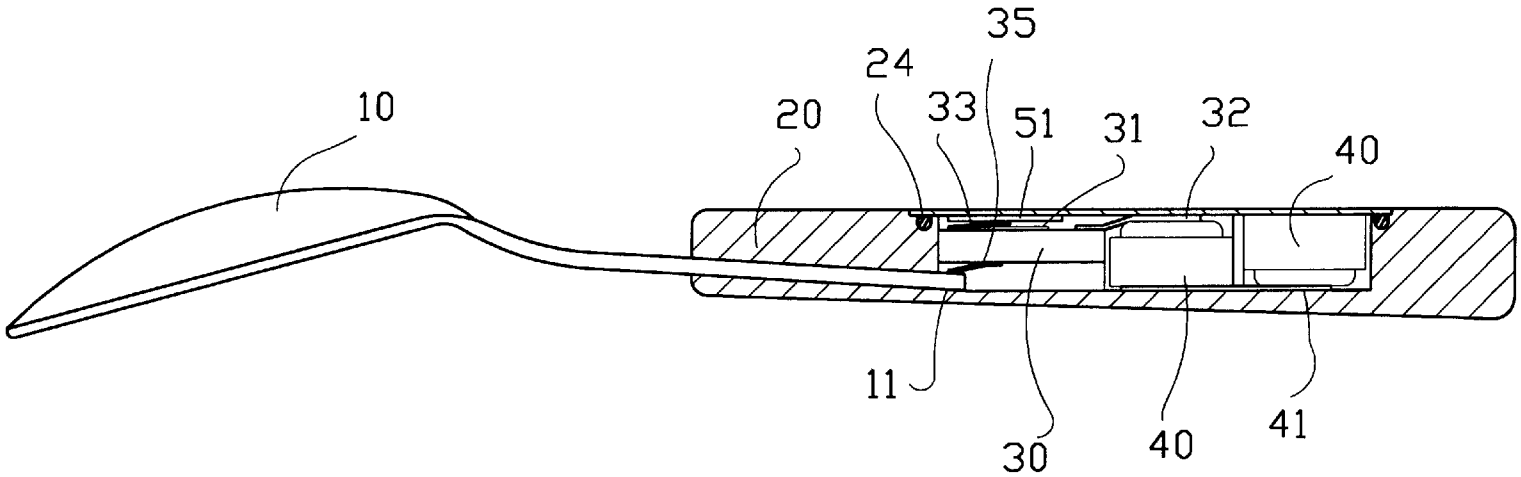
FIG. 5 is a side sectional view of the tune-producing spoon of FIG. 1.
Figure 6:
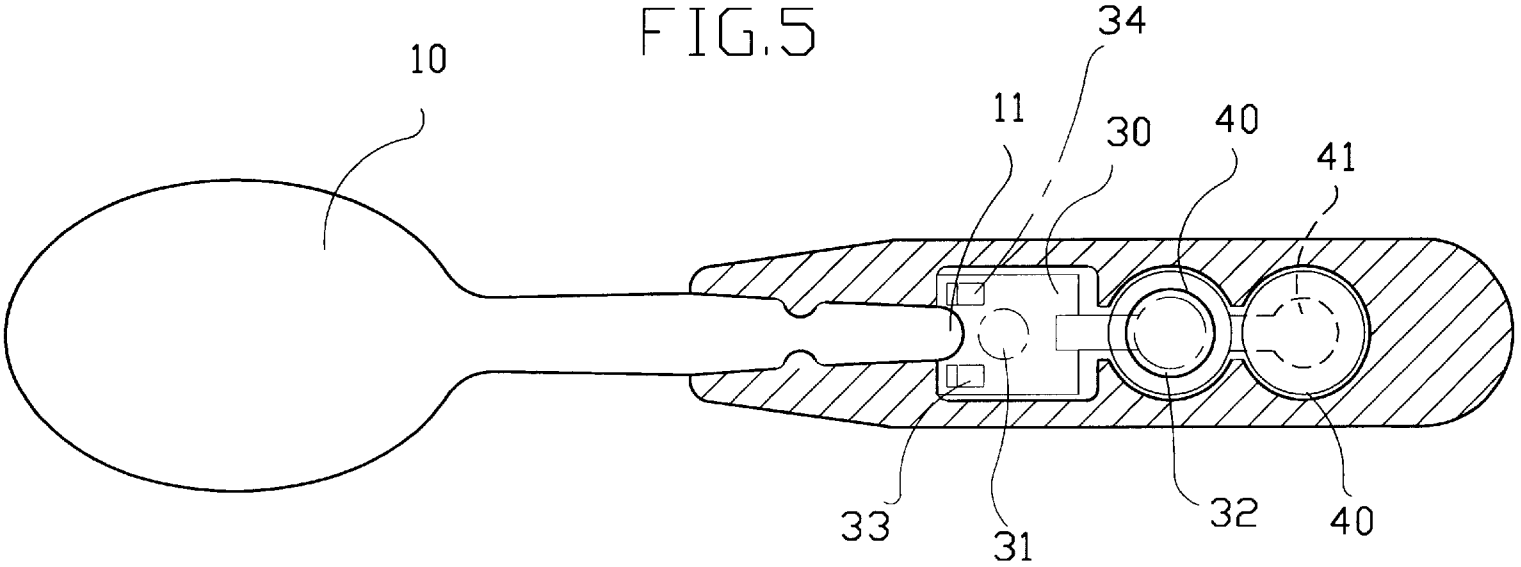
FIG. 6 is a sectional plan view of the tune-producing spoon of FIG. 1.

Please refer to FIGS. 1 and 3. The metal back cover 50 has a tune producing device 51 attached to its inner surface corresponding to the circuit board 30 in the handle portion 20 and an insulating rubber layer 52 adhered to the inner surface of the back cover 50 corresponding to the button cells 40 in the handle portion 20.

Figure 4:
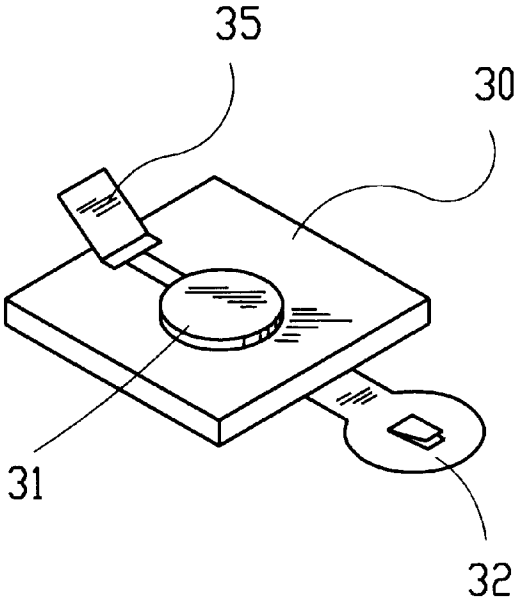
FIG. 4 is a bottom view of an IC board of the tune-producing spoon of FIG. 1.

Please now refer to FIGS. 1 and 4. The circuit board 30 has a control-by-touch integrated circuit (IC) 31 provided thereto. Three elastic plates 32, 33, and 34 are provided on a top surface of the circuit board 30 and an elastic plate 35 is provided on a bottom surface of the circuit board 30. All these four elastic plates 32, 33, 34, and 35 are electrically connected to the control-by-touch IC 31.

The back cover 50 is fitted onto the handle portion 20 to seal the circuit board 30 and the button cells 40 in the compartments 21, 22 of the handle portion 20 with the gasket 24 being tightly pressed into the groove 23 between the cover 50 and the handle portion 20. At this point, the elastic plate 35 at the bottom surface of the circuit board 30 contacts with the inner end 11 of the bowl portion 10 of the tune-producing spoon and the other three elastic plates 32, 33, and 34 at the top surface of the circuit board 30 respectively contact with negative electrode of the cells 40, the tune producing device 51, and the inner surface of the back cover 50. The insulating rubber layer 52 on the inner surface of the back cover 50 completely isolates the back cover 50 from the negative electrode of the cells 40 and the elastic plate 32 contacting with the negative electrode of the cells 40.

The back cover 50 may be a U-shaped member. An area on the handle portion 20 for receiving the back cover 50 forms a sunk area 25, so that the back cover 50 is flush with other areas of the handle portion 20 after the back cover 50 has been fitted onto the handle portion 20. A plurality of through holes 53 are formed on two sides surfaces of the back cover 50. And, a plurality of projections 26 on two side walls of the handle portion 20 corresponding to the through holes 53 on the back cover 50. Whereby, when the back cover 50 is fitted onto the handle portion 20, the through holes 53 engage with the projections 26 to firmly connect the back cover 50 to the handle portion 20. To enable convenient removal of the back cover 50 from the handle portion 20 for replacement of button cells 40, a dent 27 is provided below each projection 26, so that a tool (not shown) can be extended into the dents 27 to lift the back cover 50 from the handle portion 20.

The control-by-touch integrated circuit 31 adopted in the present invention has an internal actuating circuit. When the actuating circuit is enabled, it actuates the tune producing device 51 to send out music or voice. When a baby uses the tune-producing spoon of the present invention to feed itself, its one hand will hold the handle portion 20 and contact with the back cover 50. When the baby's mouth contacts with the bowl portion 10 of the tune-producing spoon, the baby's body serves as a conductor to allow a circuit to form between the bowl portion 10 and the back cover 50. At this point, the actuating circuit in the integrated circuit 31 on the circuit board 30 is enabled to actuate the tune producing device 51 to send out music or voice. The music or voice from the spoon helps the baby to enjoy feeding itself concentratively. The music or voice sent out by the tune producing device 51 is decided by a memory in the integrated circuit 31.

Since the integrated circuit 31 is a known skill, it is not described in details herein.

And, since the back cover 50 is tightly closed to the handle portion 20 through engagement of the holes and projections, and the gasket 24 is tightly pressed between the back cover 50 and the handle portion 20, the tune-producing spoon of the present invention is structurally watertight.

With the above arrangements, the tune-producing feeding utensil of the present invention has simple and watertight structure. The parents may feel free to let their babies use the tune-producing spoon or fork which is helpful in encouraging babies to enjoy feeding themselves.

What is claimed is:

1. A tune-producing feeding utensil comprising a metal utility portion, a plastic handle portion, a circuit board, at least one battery cell with first and second electrodes, and an electrically conductive metal back cover; wherein:

(a) said plastic handle portion contains first and second compartments for receiving said at least one battery cell and said circuit board, respectively;

(b) said metal utility portion, which serves as a feeding portion of the feeding utensil, is fixedly connected to said plastic handle portion, said metal utility portion is also electrically connected to said circuit board received in said second compartment of said handle portion;

(c) said metal cover contains an electrical contact point for electrically connecting with said first electrode; and (d) said circuit board contains a triggering circuit for triggering a tune producing device, said circuit board also contains an electrical contact for electrically connecting with said second electrode;

(e) wherein said tune-producing feeding utensil is structured such that it acts as an open circuit until said tune-producing feeding utensil is used by a child, at such time, an electrical current flows from said first electrode to said metal cover, and through the body of said child, it is allowed to flow to said metal utility portion, and to said circuit board, and finally back to said second electrode of said at least one battery, thus, causing said tune producing device to be triggered to produce a sound.

2. The tune-producing feeding utensil according to claim 1 wherein said tune producing device is disposed inside said metal and is electrically connected with said circuit board.

3. The tune-producing feeding utensil according to claim 1 which comprises two button-type battery cells laying in a flat manner in said first compartment.

4. The tune-producing feeding utensil according to claim 1 wherein said metal utility portion has a bowl shape, so as to serve as a spoon.

5. The tune-producing feeding utensil according to claim 1 wherein said metal utility portion has a fork shape, so as to serve as a fork.

6. The tune-producing feeding utensil according to claim 1 wherein said plastic portion contains a plurality of protrusions on an outside periphery of said first and second compartments, and said metal cover contains a plurality of holes matching said plurality of protrusions on said plastic handle portion so as to secure said metal cover to said plastic handle portion.

7. The tune-producing feeding utensil according to claim 1 wherein said plastic portion contains a peripheral groove, and a corresponding shaped gasket so as to seal said battery cell and said circuit board.

* * * * *